United States Patent [19]

Kato et al.

[11] 4,434,006

[45] Feb. 28, 1984

[54] FREE CUTTING STEEL CONTAINING CONTROLLED INCLUSIONS AND THE METHOD OF MAKING THE SAME

[75] Inventors: Tetsuo Kato, Nagoya; Shozo Abeyama, Chita; Atsuyoshi Kimura, Handa; Shigenobu Sekiya; Sadayuki Nakamura, both of Chita, all of Japan

[73] Assignee: Daido Tokushuko Kabushiki Kaisha, Nagoya, Japan

[21] Appl. No.: 149,939

[22] Filed: May 14, 1980

[30] Foreign Application Priority Data

May 17, 1979 [JP] Japan ..... 54-59712
May 17, 1979 [JP] Japan ..... 54-59713

[51] Int. Cl.[3] ..... C22C 33/00

[52] U.S. Cl. ..... 75/123 R; 75/123 F; 75/123 G; 75/123 N; 75/126 B; 75/126 L; 75/126 M; 75/128 A; 75/128 C; 75/128 E

[58] Field of Search ..... 75/123 AA, 123 G, 123 F, 75/123 N, 126 B, 126 L, 126 M, 128 A, 128 C, 128 P, 128 E, 123 R

[56] References Cited

U.S. PATENT DOCUMENTS 2,182,759 12/1939 Harder ..... 75/128 P
2,215,734 9/1940 Harder ..... 75/128 P
3,634,074 1/1972 Ito et al. ..... 75/126 M
3,811,875 5/1974 Goda et al. ..... 75/128 P
3,846,189 11/1974 Tipnis ..... 75/128 P
4,115,111 9/1978 Itoh et al. ..... 75/128 P
4,210,444 7/1980 Bellot ..... 75/128 P
4,255,188 3/1981 Riekels ..... 75/123 AA
4,279,646 7/1981 Kato et al. ..... 75/128 P

*Primary Examiner*—John P. Sheehan
*Attorney, Agent, or Firm*—Armstrong, Nikaido, Marmelstein & Kubovcik

[57] ABSTRACT

Mechanical anisotropy of a free cutting steel having excellent machinability can be effectively decreased by controlling inclusions so that the steel may contain inclusion A which softens at a temperature below 1000° C. and inclusion B which has a melting point above 1300° C. but exhibits plasticity at a temperature between 900° and 1300° C., that the inclusion A and the inclusion B may exist in a mutually adhered form, and that the areal percentage of the inclusion A may be at least 1% of areal percentage of the inclusion B.

Typical compositions of the inclusion A are: Pb, Bi, MnS—MnTe, $SiO_2$—$K_2O$, $SiO_2$—$Na_2O$, $SiO_2$—$K_2O$—$Al_2O_3$, $SiO_2$—$Na_2O$—$Al_2O_3$ and $SiO_2$—$Na_2O$—CaO—MnO; and typical compositions of the inclusion B are: MnS, MnSe and Mn(S,Se).

13 Claims, 6 Drawing Figures

FREE CUTTING STEEL CONTAINING CONTROLLED INCLUSIONS AND THE METHOD OF MAKING THE SAME

BACKGROUND OF THE INVENTION

1. Field of the Invention

The present invention relates to a free cutting steel containing controlled inclusions. Mechanical anisotropy of the steel is decreased by controlling the form of the inclusions without impairing good machinability thereof.

This invention is applicable to various steels such as carbon steel and alloyed steel for structural use, stainless steel, heat-resistant steel, bearing steel, tool steel and spring steel. Application to the stainless steel and the heat-resistance steel gives free cutting steels having good formability in cold forging.

This invention also relates to the method of making the above free cutting steel and products produced by hot working the free cutting steel.

2. State of the Art

In order to achieve good machinability of steel, it is practiced to add a machinability-improving element such as a metal, e.g., Pb, Bi, Ca and Te, or S or Se to steel composition. In the S- or Se-free cutting steel, which are the most widely used, these elements form inclusions of the composition MnS or MnSe, or, if both of them are used, Mn(S, Se).

Though the melting points of MnS and MnSe are so high as above 1300° C., the inclusions maintain plasticity even at a lower temperature above 900° C. If a free cutting steel containing such inclusions are hot worked, particles of the inclusion are elongated and, as a result, there arises a trouble that anisotropy in mechanical properties of the steel such as tensile strength increases.

To lighten this difficulty, addition of Ti, Zr or REM(-rare earth metals) has been made to decrease plasticity of the inclusions so that the elongation of the particles during the hot working may be lowered. This resulted in an increase in the hardness of the inclusion, however, it inevitably weakens the expected effect of improving machinability of the steel.

SUMMARY OF THE INVENTION

An object of the present invention is to satisfy the demand for the free cutting steel which exhibits excellent machinability, the mechanical anisotropy of which does not increase through hot working.

Another object of this invention is to provide a preferable method of making the above free cutting steel.

Further object of this invention is to provide products obtained by hot working the above steel.

This invention is based on the idea of using an inclusion of a lower melting point as a lubricating or cushioning material for an inclusion of a higher softening or melting point so as to prevent deformation of the latter during working. Experimental results have proved effectiveness of this idea and have led to the present invention.

DRAWINGS

FIGS. 2A through 2E are microscopic photographs showing the form of inclusion particles in the steel according to the present invention at the stage after water-quenching subsequent to:

Figure 2A:
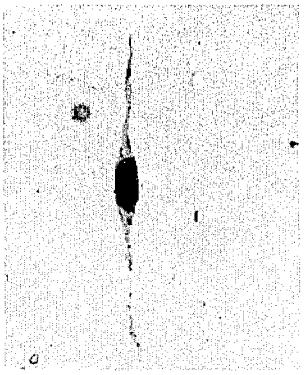
Figure 2B:
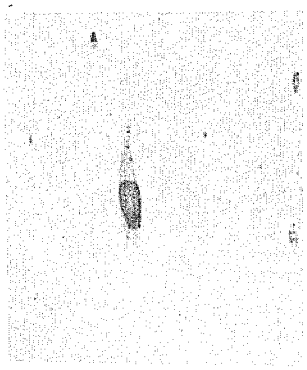
Figure 2C:
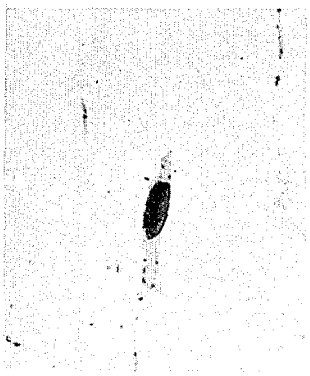
Figure 2D:
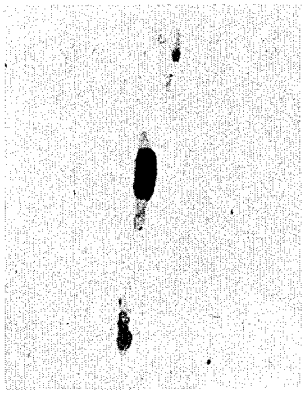
Figure 2E:
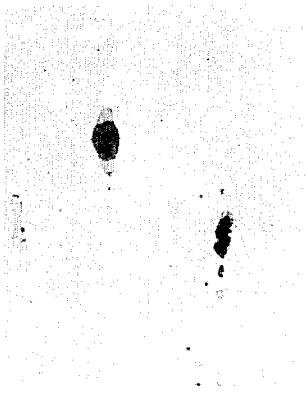

FIG. 2A: rolling at 1150° C., and after the rolling,
FIG. 2B: soaking at 900° C. for 1 hour,
FIG. 2C: soaking at 1000° C. for 1 hour,
FIG. 2D: soaking at 1100° C. for 1 hour, and
FIG. 2E: soaking at 1150° C. for 1 hour.

PREFERRED EMBODIMENT OF THE INVENTION

The free cutting steel of the present invention containing controlled inclusions is characterized in that the steel contains inclusion A which softens or melts at a temperature below 1000° C. and inclusion B which has a melting point above 1300° C. but exhibits plasticity at a temperature between 900° and 1300° C., in that the inclusion A and the inclusion B exist in a mutually adhered form, and in that areal percentage of the inclusion A is at least 1% of areal percentage of the inclusion B. (The areal percentage is defined later).

During hot working of the steel, deformation of inclusion particles caused by deformation of the matrix steel is beared mainly by the inclusion A, and accordingly, the elongation of the inclusion B is significantly reduced. This is the a effect of controlling the inclusion according to the invention.

The reason why the inclusion A must have softening or melting point below 1000° C. is that, higher softening or melting point would not give the above mentioned effect to an appreciable extent during usual hot working. On the other hand, the inclusion should not have a too low softening or melting point such as 100° C. or lower, because it damages strength of the steel at a normal temperature.

Typical substances suitable for the inclusion A are members of the following group. They have a softening or melting temperature, which satisfies the above requirement:

Low melting point metals: Pb(330° C.), Bi(270° C.)
MnS-MnTe(MnS%:MnTe% $\approx$ 3:97) (810° C.),
Oxides composit containing an alkali metal oxide:
$SiO_2$—$K_2O$(70:30) (about 800° C.)
$SiO_2$—$Na_2O$(70:30) (about 800° C.)
$SiO_2$—$K_2O$—$Al_2O_3$(70:20:10) (about 900° C.)
$SiO_2$—$Na_2O$—$Al_2O_3$(70:20:10) (about 900° C.)
$SiO_2$—$Na_2O$—CaO—MnO(50:20:10:10) (about 950° C.)

In order to obtain the effect of coexistence of the inclusions, it is necessary, as seen from the above description, that they must be in the form of mutual adhesion. Particularly, it is prefeable that the inclusion A surrounds the inclusion B.

According to our experience, mechanical anisotropy of the free cutting steel mainly relies upon relatively large inclusion particles having average diameter 5$\mu$ (projection area of which is about 20$\mu^2$) or more. If almost all the large inclusion particles as mentioned above, consist of mutually adhered inclusion A and inclusion B, the steel exhibits expected low anisotropy, even if smaller inclusion particles are not necessarily in the form of adhered inclusions.

In order that the coexisting adhered inclusions A and B provide the above effect of lubrication, it is necessary that the areal percentage of the inclusion A be at least 1% of the areal percentage of the inclusion B.

The term "areal percentage" means that, in microscopic observation of a certain cross section of a piece of free cutting steel, the rate of total projective area of inclusion particles found in a certain field of view to the area of the field.

A large amount of inclusion A impairs high temperature strength of the steel, and therefore, the above percentage should have an upper limit in some steels such as heat-resistant steel. The preferable range of the areal percentage of the inclusion A is 10 to 150% of the areal percentage of the inclusion B.

According to our experience concerning application of the present invention to stainless steel and heat-resistant steel, if the steel is required to have not only high machinability but also good formability in cold forging, it is necessary that at least 80% of sulfide-based relatively large inclusion particles of a length of 2μ or longer have an aspect ratio, or the ratio length/width of the particle, not higher than 10. Such inclusion particles can be formed in the steel by selecting a %Te/%S of 0.04 or higher, and by controlling oxygen content to be not higher than 0.015%.

Chemical compositions of the stainless steel and the heat-resistant steel having good formability in cold forging are as follows:

| | Stainless Steel | Heat-Resistant Steel |
|---|---|---|
| C | up to 2.0% | up to 1.0% |
| Si | up to 2.0% | up to 5.0% |
| Mn | up to 10% | up to 20% |
| Cr | 10 to 30% | 7.5 to 30% |
| S | up to 0.4% (% Te/% S ≧ 0.04) | |
| Te | up to 0.5% | |
| O | up to 0.015% | |
| Fe | balance | |

The roles of these elements and the significance of the limits of addition are known except for those concerning the inclusions. The following explains the significance of the combination of the machinability-improving elements, Te-S and oxygen content, in connection with the form of inclusions.

S: up to 0.4%

Sulphur is essential to form MnS-based inclusion, which is the principal inclusion for providing good machinability. At a higher content the machinability is higher, while the formability in cold forging and corrosion resistance is low, and thus, the above upper limit is given.

Te: up to 0.50%

Telurium takes an important role in controlling the form of MnS-based inclusion which has great influence on the formability in cold forging and providing machinability of the steel. The content is limited because of lower formability in hot working at a higher content. For the purpose of improving the form of sulfide-based inclusions the ratio %Te/%S should be 0.04 or more.

O: up to 0.015%

Oxygen in steel usually exists in the form of $Al_2O_3$ and $SiO_2$. If the steels containing a large amount of Cr such as stainless steel and heat-resistant steel, it forms an appreciable amount of $CrO_3$.

These oxides are very hard and seriously damages cutting tools, and further, they become the starting points of inner cracks during cold forging. Thus, the content of oxygen should be as low as possible. Our experiments revealed that the permissible upper limit is 0.015%, as noted above.

Form and distribution of sulfide-based inclusion:

We established that the machinability and formability in cold forging largey depend on the form and distribution of the sulfide-based inclusion particles in the steel. We studied properties of steels containing inclusion of different forms. It is our conclusion that the formability in cold forging is determined by relatively large sulfide-based inclusion particles of a diameter of 2μ or more, and that these large-sized inclusion particles have no unfavorable influence when they have aspect ratios or the ratio length/width not larger than 10, or, in other words, unless they are not so extremly elongated. We also concluded that such large-sized particles should account for at least 80% of total number of the sulfide-based inclusion particles.

This is supported by experimental facts described later.

The free cutting stainless steel and heat-resistant steel having good formability in cold forging may contain, if desired, one or more of the elements selected from the following groups to improve strength, corrosion resistance, abrasion resistance or anti-scaling property:

Ni: up to 40%,

Mo: up to 4.0%

One or more of W: up to 5.0%, Ti: up to 2.0%, V: up to 2.0%, Nb: up to 1.5% and REM: up to 0.5%, Al: up to 2.0%, Co: up to 25%

One or more of B: up to 0.05%, N: up to 0.80% and Zr: up to 2%,

Ta: up to 1.5%, and

Cu: up to 7%.

Where further improvement in the machinability of the present free cutting stainless steel is desired and heat-resistant steel, it is effective to add one or more of Pb: up to 0.30%, Se: up to 0.30%, Ca: up to 0.06% or Bi: up to 0.30%. The upper limits of addition are determined in view of the influence on the properties such as formability in cold forging, strength, corrosion resistance or heat-resistance. These elements may be added together with the above mentioned alloying elements.

The method of making the free cutting steel containing the controlled inclusions according to the present invention generally comprises intimately mixing a substance having a composition of the inclusion A which softens or melts at a temperature below 1000° C. and a substance having a composition of the inclusion B which has a melting point above 1300° C. but exhibits plasticity at a temperature between 900° and 1300° C., and adding this prepared mixture to a molten steel under stirring by blowing a non-oxidative gas so as to disperse the mixture therein. For the purpose of realizing the above noted preferable proportion of the inclusion A and inclusion B in the large particles consisting of these inclusions, it is recommended to mix and use the substance having the composition of the inclusion A and the substance having the composition of the inclusion B at a volume ratio ranging from 1:100 to 150:100.

As an alternative, it is practicable to add powder of the substance having the composition of the inclusion B to the molten steel, and to slowly cool the cast molten steel so that the inclusion B inherently contained in the steel may precipitate arround the added powder as seeds, and that the inclusion A may precipitate surrounding the precipited inclusion B. A suitable amount of addition of the substance having the composition of the inclusion B, which will act as seeds for the precipitation, is 5% or more of the inclusion B which will be finally contained in the steel. Thus, size of the inclusion particles can be relatively small.

The mechanism of achieving the desired effect in the free cutting steel containing controlled inclusions according to the invention is based on the fact that, as described above, deformation resulted from hot working is buffered by the inclusion A and give little influence to the inclusion B. This is caused by the difference in the plasticities of the inclusions at the hot working temperature. Therefore, if a product is made from the present free cutting steel by hot working, it is essential to practice at a temperature above the softening or melting point of the inclusion A.

Further, we have discovered that, if the product made by hot working the free cutting steel of the invention is soaked at a temperature above 900° C., the inclusion A, which was elongated once, is apt to spheroidize. The spheroidization of course occurs more quickly at a higher temperature, and proceeds as the time passes. As a result of the spheroidization of the inclusion A, the inclusion particles which consist of adhered inclusions A and B becomes a nearly spherical, spindle-like form. This is the reason why the present invention gives hot worked free cutting steel products having little mechanical anisotropy.

The effect of soaking at a temperature above 900° C. can be obtained, if the worked piece is large enough and the hot working is carried out at a sufficiently high temperature, by making use of remaining heat after the working. In case where the worked piece is small or a higher effect is desired, the piece should be kept under heating.

EXAMPLES

EXAMPLE I (Carbon steel for structural use)

Mixtures of the substance having the composition of the inclusion A and the substance having the composition of the inclusion B were prepared in various combination. In an arc furnace, molten steels of the chemical composition shown in Table I-1 were prepared, and the steels were poured from a ladle to cast ingots weighing 1.3 tons. The above mixtures were added to the stream of the molten steels during the casting.

In the Tables throughout the Examples, run numbers with alphabetical notation are control examples.

The steel ingots thus cast were hot-rolled (under forging ratio of about 12), soaked at 1000° C. for 2 hours, and after being cooled, subjected to various tests.

Firstly, specimens for microscopic observation were taken out from the samples by cutting along longitudinal cross section (parallel to the rolling direction), and the specimens were observed. The areal percentages of the inclusions A and B in a certain field of view were measured in accordance with the method defined in JIS G 0555, and the rate "C" of the inclusion particles which consist of adhered inclusion A and inclusion B (% by number) among 200 relatively large inclusion particles of diameter of 5$\mu$(projective area: about 20 $\mu^2$) or larger was counted. Further, the average aspect ratios L/S, or the ratios length-width of these 200 inclusion particles were calculated. Magnification of the microscope was 400 in general, and in case of areal percentage less than 0.03, 800.

The results are shown in Table I-2 with the compositions of the inclusions. In the present steels more than 90% of large inclusion particles are the type of coexisting, adhered inclusions, which particles have small L/S, and can be regarded as substantially spherical.

Then, other specimens were taken out from surface parts of the samples in the directions parallel to the rolling direction and rectangular thereto. The specimens were, after quenching and tempering (850° C. oil cooling-600° C. water quenching), processed to JIS-No. 4 tensile test pieces. The results of the tensile test are shown in Table I-3. From the Table it is seen that the anisotropy in mechanical properties of the present steels is small.

Further, subsequent to normalization:

(850° C. air quenching), the specimens underwent cutting test under the following conditions:

Drill: straight shank drill: SKH 9, diameter 5.0
Feed: 0.10 mm/rev.
Depth of hole: 20 mm, blind hole
Cutting speed: 30 m/min
Cutting oil: none
Criterion on the tool life: total depth of hole cut until the drill cuts no longer The results are given in Table I-4, which shows excellent machinability of present steel.

TABLE I - 1

| Run No. | Chemical Composition (%) C | Si | Mn |
|---|---|---|---|
| I - 1 | 0.45 | 0.23 | 0.50 |
| I - 2 | 0.46 | 0.26 | 0.48 |
| I - 3 | 0.45 | 0.26 | 0.52 |
| I - 4 | 0.45 | 0.29 | 0.50 |
| I - A | 0.47 | 0.24 | 0.60 |
| I - B | 0.45 | 0.25 | 0.42 |

TABLE I - 2

| Run No. | Areal Percentage (%) Inclusion A | Inclusion B | A/B % | C % | L/S % |
|---|---|---|---|---|---|
| I - 1 | MnS—MnTe 0.30 | MnS 0.25 | 120 | 100 | 2.8 |
| I - 2 | MnS—MnTe 0.003 | Mn(S,Se) 0.23 | 13 | 96 | 2.6 |
| I - 3 | $SiO_2$—$Na_2O$ 0.025 | MnS 0.22 | 11 | 98 | 2.6 |
| I - 4 | $SiO_2$—$K_2O$—$Al_2O_3$ 0.080 | MnS 0.24 | 33 | 100 | 2.7 |
| I - A | — | MnS 0.23 | — | — | 22.3 |
| I - B | MnS—MnTe 0.001 | MnS 0.23 | 0.4 | 34 | 16.2 |

TABLE I - 3

| Run No. | Tensile Strength (kg/mm$^2$) Rolling Direction X | Rectangular Direction Y | Y/X | Reduction of Area (%) Rolling Direction X | Rectangular Direction Y | Y/X |
|---|---|---|---|---|---|---|
| I - 1 | 85 | 83 | 0.98 | 62 | 43 | 0.69 |
| I - 2 | 86 | 84 | 0.98 | 62 | 40 | 0.65 |
| I - 3 | 85 | 84 | 0.99 | 65 | 42 | 0.65 |
| I - 4 | 84 | 82 | 0.98 | 64 | 41 | 0.64 |
| I - A | 82 | 76 | 0.93 | 58 | 18 | 0.31 |
| I - B | 82 | 78 | 0.95 | 59 | 24 | 0.40 |

TABLE I - 4

| Run No. | Drill Life (mm) |
|---|---|
| I - 1 | 4940 |
| I - 2 | 3860 |
| I - 3 | 3660 |
| I - 4 | 3280 |

TABLE I - 4-continued

| Run No. | Drill Life (mm) |
|---|---|
| I - A | 2160 |
| I - B | 2350 |

EXAMPLE II (Alloy steel for structural use)

Steel ingots were prepared through the procedure similar to that of Example I, and the samples were subjected to the tests. The sample of Run No. II-3 represents the case without the soaking at 1000° C. for 2 hours.

Table II-2 shows the record on the inclusions.

Table II-3 shows the test results on the mechanical anisotropy. Quenching and tempering of the specimens were carried out under the following conditions:

870° C. oil cooling—830° C. oil cooling—200° C. air cooling

Table II-4 shows the results of machining test. Tempering of the specimens were made by heating at 900° C. followed by air cooling.

TABLE II-1

| | Chemical Composition (%) | | | | |
|---|---|---|---|---|---|
| Run No. | C | Si | Mn | Cr | Mo |
| II-1 | 0.20 | 0.24 | 0.71 | 1.05 | 0.21 |
| II-2 | 0.21 | 0.22 | 0.78 | 1.06 | 0.25 |
| II-3 | 0.20 | 0.24 | 0.71 | 1.05 | 0.21 |
| II-A | 0.20 | 0.24 | 0.70 | 0.99 | 0.21 |

TABLE II-2

| | Areal Percentage (%) | | A/B | C | |
|---|---|---|---|---|---|
| Run No. | Inclusion A | Inclusion B | % | % | L/S |
| II-1 | MnS—MnTe 0.010 | MnS 0.072 | 1.4 | 100 | 2.9 |
| II-2 | Pb 0.020 | MnS 0.065 | 31 | 96 | 2.8 |
| II-3 | MnS—MnTe 0.010 | MnS 0.072 | 1.4 | 100 | 3.6 |
| II-A | MnS—MnTe 0.008 | MnS 0.064 | 1.2 | 55 | 4.2 |

TABLE II-3

| | Tensile Strength (kg/mm²) | | | Reduction of Area (%) | | |
|---|---|---|---|---|---|---|
| Run No. | Rolling Direction X | Rectangular Direction Y | Y/X | Rolling Direction X | Rectangular Direction Y | Y/X |
| II-1 | 113 | 112 | 0.99 | 63 | 52 | 0.83 |
| II-2 | 112 | 111 | 0.99 | 62 | 50 | 0.81 |
| II-3 | 113 | 110 | 0.97 | 62 | 48 | 0.77 |
| II-A | 110 | 103 | 0.94 | 56 | 30 | 0.54 |

TABLE II-4

| Run No. | Drill Life (mm) |
|---|---|
| II-1 | 14620 |
| II-2 | 18640 |
| II-3 | 16300 |
| II-A | 10320 |

EXAMPLE III (Stainless steel)

Steel ingots were prepared through the procedure similar to that of Example I, and the samples were subjected to the tests.

Table III-2 shows the record on the inclusions.

Table III-3 shows the test results on the mechanical anisotropy. The specimens were tested after anealing under the condition of heating 800° C. air cooling.

Table III-4 shows the results of machining test. The specimens were tested also after anealing of 800° C. air cooling.

TABLE III-1

| | Chemical Composition (%) | | | | |
|---|---|---|---|---|---|
| Run No. | C | Si | Mn | Cr | Mo |
| III-1 | 0.08 | 0.42 | 0.85 | 17.25 | 0.35 |
| III-A | 0.08 | 0.35 | 0.88 | 17.04 | 0.38 |

TABLE III-2

| | Areal Percentage (%) | | A/B | C | |
|---|---|---|---|---|---|
| Run No. | Inclusion A | Inclusion B | % | % | L/S |
| III-1 | MnS—MnTe 0.034 | MnSe 1.15 | 3.0 | 99 | 2.4 |
| III-A | — | MnSe 1.04 | — | — | 20.5 |

TABLE III-3

| | Tensile Strength (kg/mm²) | | | Reduction of Area (%) | | |
|---|---|---|---|---|---|---|
| Run No. | Rolling Direction X | Rectangular Direction Y | Y/X | Rolling Direction X | Rectangular Direction Y | Y/X |
| III-1 | 56 | 54 | 0.96 | 66 | 54 | 0.82 |
| III-A | 55 | 50 | 0.91 | 60 | 28 | 0.47 |

TABLE III-4

| Run No. | Drill Life (mm) |
|---|---|
| III-1 | 2360 |
| III-A | 1400 |

EXAMPLE 4

Stainless steels of the composition shown in Table IV-1 were prepared and cast.

The ingots were processed by rolling or forging into rods of 60 mm diameter. Some of them were further processed by cold drawing.

Specimens were taken from the sample rods for the following tests.

(1) Form and distribution of sulfide-based inclusions.

Specimens for microscopic observation were made from the sample rods by cutting out along the rolling or forging direction, and polishing. Among the sulfide-based inclusion particles found in a certain field of view, 200 particles having length of 2μ or longer were measured their length(L) and width(S) to calculate average L/S, and the rate R (% by number) of the particles having the L/S less than 10 was determined. These values are shown in Table IV-2.

(2) Formability in cold forging

From the part other than central part of the rods of 60 mm diameter, specimens of 9 mm diameter and 12 mm long were cut out, and, after heat-treatment, polished up to 8 mm diameter.

The test pieces were subjected to cold upset test with 30 times repetition, and the averaged values of the critical strain were calculated.

The critical strain is defined as:

Ln(Ho/H)

wherein Ho:12 mm, H: length of the sample(mm) at the time of cracks occur.

The data are shown also in Table IV-2.

(3) Machinability

The rods of 60 mm diameter were heat-treated and their black skin was peeled for the cutting test under the conditions below:

Cutting Conditions

Tool: tip: P20 square tip holder:P11R44, 5,5,6,6,15,15,0,4
Feed: 0.15 mm/rev.
Depth of Cut: 1.0 mm
Cutting oil: None
Criterion of the tool life:
flank wear $V_B$=0.2 mm Table IV-2 includes the cutting test results.

TABLE IV-1

| Run No. | C % | Si % | Mn % | P % | S % | Te % | Te/S | Ni % | Cr % | Mo % | C % | Others % | | Pb, Se, Ca, Bi % | |
|---|---|---|---|---|---|---|---|---|---|---|---|---|---|---|---|
| IV-1 | 0.08 | 0.60 | 1.25 | 0.022 | 0.055 | 0.011 | 0.20 | 8.50 | 17.65 | 0.02 | 0.0135 | | | | |
| IV-2 | 0.08 | 0.63 | 1.18 | 0.020 | 0.057 | 0.048 | 0.84 | 8.43 | 17.73 | 0.03 | 0.0128 | Ti | 1.55 | | |
| IV-3 | 0.08 | 0.58 | 1.22 | 0.020 | 0.055 | 0.058 | 1.05 | 8.43 | 17.70 | 0.02 | 0.0115 | | | Se | 0.22 |
| IV-4 | 0.07 | 0.65 | 1.15 | 0.021 | 0.058 | 0.103 | 1.78 | 8.55 | 17.65 | 0.02 | 0.0108 | Ti | 1.55 | Se | 0.14 |
| | | | | | | | | | | | | | | Ca | 0.025 |
| IV-A | 0.07 | 0.53 | 1.21 | 0.018 | 0.050 | 0.001 | 0.02 | 8.40 | 17.30 | 0.02 | 0.0155 | | | | |
| IV-B | 0.07 | 0.54 | 1.22 | 0.021 | 0.055 | — | — | 8.43 | 17.55 | 0.02 | 0.0165 | | | | |
| IV-5 | 0.10 | 0.58 | 0.78 | 0.017 | 0.351 | 0.08 | 0.23 | 0.10 | 13.50 | 0.10 | 0.0093 | | | | |
| IV-6 | 0.11 | 0.59 | 0.80 | 0.015 | 0.323 | 0.10 | 0.31 | 0.09 | 13.44 | 0.03 | 0.0092 | Al | 0.25 | | |
| | | | | | | | | | | | | B | 0.044 | | |
| IV-7 | 0.10 | 0.60 | 0.80 | 0.015 | 0.350 | 0.43 | 1.23 | 0.09 | 13.48 | 0.10 | 0.0095 | | | Ca | 0.005 |
| IV-8 | 0.12 | 0.61 | 0.82 | 0.017 | 0.320 | 0.31 | 0.97 | 0.08 | 13.24 | 0.02 | 0.0098 | Al | 0.23 | Pb | 0.05 |
| | | | | | | | | | | | | B | 0.040 | | |
| IV-C | 0.09 | 0.57 | 0.77 | 0.018 | 0.350 | — | — | 0.09 | 13.43 | 0.11 | 0.0175 | | | | |
| IV-9 | 0.35 | 0.78 | 0.81 | 0.018 | 0.100 | 0.01 | 0.100 | 0.21 | 18.50 | 0.15 | 0.0065 | | | | |
| IV-10 | 0.33 | 0.77 | 0.78 | 0.020 | 0.095 | 0.05 | 0.53 | 0.18 | 18.25 | 0.14 | 0.0055 | REM | 0.44 | | |
| IV-11 | 0.33 | 0.77 | 0.79 | 0.019 | 0.099 | 0.08 | 0.81 | 0.17 | 18.44 | 0.15 | 0.0058 | | | Bi | 0.20 |
| IV-12 | 0.30 | 0.75 | 0.77 | 0.019 | 0.090 | 0.07 | 0.78 | 0.15 | 18.31 | 0.15 | 0.0055 | REM | 0.44 | Bi | 0.07 |
| IV-D | 0.35 | 0.81 | 0.85 | 0.015 | 0.091 | 0.01 | 0.11 | 0.21 | 18.45 | 0.14 | 0.0075 | | | | |
| IV-E | 0.36 | 0.80 | 0.82 | 0.017 | 0.095 | — | — | 0.20 | 18.33 | 0.15 | 0.0095 | | | | |
| IV-13 | 1.20 | 0.63 | 1.10 | 0.035 | 0.150 | 0.251 | 1.67 | 0.15 | 17.32 | 0.05 | 0.0025 | | | | |
| IV-14 | 1.15 | 0.65 | 1.15 | 0.034 | 0.155 | 0.283 | 1.83 | 0.18 | 17.44 | 0.05 | 0.0031 | Zr | 1.77 | | |
| | | | | | | | | | | | | N | 0.25 | | |
| IV-15 | 1.15 | 0.60 | 1.12 | 0.033 | 0.145 | 0.243 | 1.68 | 0.12 | 17.33 | 0.05 | 0.0022 | | | Pb | 0.23 |
| IV-16 | 1.13 | 0.63 | 1.13 | 0.035 | 0.160 | 0.263 | 1.64 | 0.20 | 17.70 | 0.03 | 0.0023 | Zr | 1.60 | Bi | 0.05 |
| | | | | | | | | | | | | N | 0.23 | Ca | 0.03 |
| | | | | | | | | | | | | | | Se | 0.10 |
| IV-F | 1.17 | 0.66 | 1.21 | 0.033 | 0.151 | — | — | 0.17 | 17.30 | 0.04 | 0.0043 | Zr | 1.70 | | |
| | | | | | | | | | | | | N | 0.22 | | |
| IV-17 | 0.06 | 1.25 | 1.31 | 0.021 | 0.010 | 0.005 | 0.50 | 21.53 | 27.54 | 0.03 | 0.0068 | | | | |
| IV-G | 0.05 | 1.28 | 1.15 | 0.018 | 0.009 | 0.002 | 0.22 | 21.44 | 27.54 | 0.02 | 0.0135 | | | | |
| IV-18 | 0.02 | 0.45 | 1.22 | 0.021 | 0.028 | 0.007 | 0.25 | 13.48 | 19.50 | 3.85 | 0.0071 | Cu | 3.50 | | |
| IV-19 | 0.02 | 0.41 | 1.21 | 0.019 | 0.025 | 0.001 | 0.04 | 13.44 | 18.66 | 3.40 | 0.0070 | Cu | 3.44 | | |
| IV-20 | 0.02 | 0.42 | 1.20 | 0.019 | 0.027 | 0.005 | 0.19 | 13.50 | 18.99 | 3.80 | 0.0073 | Cu | 3.50 | Se | 0.15 |
| IV-H | 0.02 | 0.45 | 1.21 | 0.018 | 0.018 | — | 0.03 | 13.48 | 13.78 | 3.75 | 0.0110 | Cu | 3.33 | | |
| IV-I | 0.03 | 0.48 | 1.18 | 0.018 | 0.018 | — | — | 13.54 | 19.27 | 3.80 | 0.0105 | Cu | 3.50 | | |

TABLE IV-2

| | Sulfides | | Formability | | Machinability | |
|---|---|---|---|---|---|---|
| Run No. | L/S | R (%) | Heat Treatment | Critical Strain | Heat Treatment | 60 min-Life Speed (m/min) |
| IV-1 | 3.5 | 84 | | 1.74 | | 243 |
| IV-2 | 2.0 | 83 | | 1.70 | | 235 |
| IV-3 | 1.9 | 81 | 1050° C. | 1.63 | 1050° C. | 255 |

TABLE IV-2-continued

| | Sulfides | | Formability | | Machinability | |
|---|---|---|---|---|---|---|
| Run No. | L/S | R (%) | Heat Treatment | Critical Strain | Heat Treatment | 60 min-Life Speed (m/min) |
| IV-4 | 1.5 | 88 | × 1 hr Water Quenching | 1.60 | × 1 hr Water Quenching | 273 |
| IV-A | 8.5 | 65 | | 1.48 | | 215 |
| IV-B | 11.5 | 2 | | 1.45 | | 210 |
| IV-5 | 8.1 | 87 | | 1.91 | | 150 |
| IV-6 | 3.8 | 87 | | 1.82 | | 143 |
| IV-7 | 2.3 | 85 | 830° C. × 1 hr Furnace Cooling | 1.95 | 830° C. × 1 hr Furnace Cooling | 162 |
| IV-8 | 2.5 | 84 | | 1.78 | | 161 |
| IV-C | 15.8 | 5 | | 1.55 | | 125 |
| IV-9 | 4.3 | 85 | | 1.96 | | 173 |
| IV-10 | 3.7 | 83 | | 1.95 | | 175 |
| IV-11 | 3.5 | 81 | 830° C. × 1 hr Furnace Cooling | 1.90 | 830° C. × 1 hr Furnace Cooling | 178 |
| IV-12 | 2.3 | 82 | | 1.87 | | 180 |
| IV-D | 10.5 | 0 | | 1.71 | | 143 |
| IV-E | 11.3 | 65 | | 1.70 | | 140 |
| IV-13 | 2.3 | 87 | | 1.66 | | 74 |
| IV-14 | 2.5 | 86 | | 1.54 | | 78 |
| IV-15 | 2.3 | 85 | 830° C. × 1 hr Furnace Cooling | 1.58 | 830° C. × 1 hr Furnace Cooling | 85 |
| IV-16 | 2.5 | 84 | | 1.50 | | 88 |
| IV-F | 12.5 | 1 | | 1.28 | | 62 |
| IV-17 | 2.7 | 83 | | 1.93 | | 185 |
| IV-G | 10.8 | 0 | | 1.55 | | 150 |
| IV-18 | 3.4 | 85 | | 1.92 | | 195 |
| IV-19 | 7.5 | 80 | 1050° C. × 1 hr Water | 1.90 | 1050° C. × 1 hr Water | 190 |

TABLE IV-2-continued

| Run No. | Sulfides L/S | Sulfides R (%) | Formability Heat Treatment | Formability Critical Strain | Machinability Heat Treatment | Machinability 60 min-Life Speed (m/min) |
|---|---|---|---|---|---|---|
| IV-20 | 3.7 | 85 | Quenching | 1.98 | Quenching | 206 |
| IV-H | 10.7 | 15 | | 1.50 | | 165 |
| IV-I | 12.3 | 0 | | 1.48 | | 163 |

EXAMPLE 5

(Heat-resistant steel)

Steel ingots of the chemical composition shown in Table V-1 were prepared through the procedure similar to that of Example I and tested.

Table V-2 shows the record on the inclusions in the steel.

Table V-3 shows the test results of mechanical anisotropy. The specimens were subjected to solution-treatment by being heated at 1050° C. and water-cooled before the test.

Table V-4 shows the test results of machinability. The specimens were also solution-treated under the above noted condition.

TABLE V-1

| Run No. | Chemical Composition (%) C | Si | Mn | Ni | Cr | Mo |
|---|---|---|---|---|---|---|
| V-1 | 0.06 | 0.35 | 0.87 | 9.64 | 19.05 | 0.15 |
| V-A | 0.07 | 0.37 | 0.76 | 9.25 | 19.12 | 0.13 |

TABLE V-2

| Run No. | Areal Percentage (%) Inclusion A | Inclusion B | A/B % | C % | L/S |
|---|---|---|---|---|---|
| V-1 | MnS—MnTe 0.009 | MnS 0.058 | 16 | 99 | 2.8 |
| V-A | — | MnS 0.062 | — | — | 24.2 |

TABLE V-3

| Run No. | Tensile Strength ($kg/mm^2$) Rolling Direction X | Rectangular Direction Y | Y/X | Reduction of Area (%) Rolling Direction X | Rectangular Direction Y | Y/X |
|---|---|---|---|---|---|---|
| V-1 | 60 | 58 | 0.97 | 68 | 58 | 0.85 |
| V-A | 58 | 53 | 0.91 | 66 | 34 | 0.52 |

TABLE V-4

| Run No. | Drill Life (mm) |
|---|---|
| V-1 | 1040 |
| V-A | 420 |

EXAMPLE 6

(Heat resistant steel)

Heat resistant steels of different compositions were prepared and processed to rods of 60 mm diameter. The compositions of the samples are shown in Table VI-1.

Specimens were taken out from the samples for the following tests.

(1) Form and distribution of inclusions (2) Formability in cold forging (3) Machinability There were employed the testing method same as those of Example 4. The test gave the similar results.

(4) High temperature strength Specimens for hot tensile test were taken by cutting out from the outer part of the sample rods, and after heat-treatment, processed to have parallel part of 10 mm diameter. Tensile strength and reduction of area were measured at 800° C.

The results are shown in Table IV-2 together with the test results of the above (1) to (3).

TABLE VI-1

| Run No. | C % | Si % | Mn % | P % | S % | Te % | Te/S | Ni % | Cr % | Mo % | O % | Others % | | Pb, Se, Ca, Bi % | |
|---|---|---|---|---|---|---|---|---|---|---|---|---|---|---|---|
| VI-1 | 0.40 | 1.98 | 0.34 | 0.015 | 0.036 | 0.006 | 0.17 | 14.25 | 15.16 | 0.01 | 0.0013 | W | 4.56 | | |
| VI-2 | 0.41 | 1.95 | 0.35 | 0.017 | 0.037 | 0.004 | 0.11 | 14.33 | 15.17 | 0.01 | 0.0025 | W | 4.50 | Pb | 0.15 |
| VI-A | 0.38 | 1.83 | 0.34 | 0.017 | 0.037 | — | — | 14.23 | 15.15 | 0.01 | 0.0039 | W | 4.33 | | |
| VI-3 | 0.45 | 0.81 | 0.72 | 0.015 | 0.110 | 0.017 | 0.16 | 5.01 | 25.50 | 5.50 | 0.0015 | | | | |
| VI-4 | 0.45 | 0.80 | 0.76 | 0.016 | 0.109 | 0.025 | 0.22 | 5.11 | 25.31 | 5.30 | 0.0020 | | | Se | 0.18 |
| VI-B | 0.43 | 0.76 | 0.77 | 0.016 | 0.115 | — | — | 5.10 | 25.43 | 5.44 | 0.0038 | | | | |
| VI-5 | 0.44 | 0.79 | 4.12 | 0.015 | 0.160 | 0.311 | 1.94 | 2.11 | 25.31 | 3.55 | 0.0025 | N | 0.46 | | |
| VI-6 | 0.45 | 0.81 | 4.10 | 0.016 | 0.155 | 0.253 | 1.63 | 2.10 | 25.30 | 3.60 | 0.0031 | N | 0.44 | Bi | 0.17 |
| VI-C | 0.41 | 0.74 | 4.12 | 0.016 | 0.155 | — | — | 2.13 | 25.40 | 3.22 | 0.0047 | N | 0.41 | | |
| VI-7 | 0.60 | 0.82 | 8.40 | 0.018 | 0.035 | 0.125 | 3.57 | 0.26 | 22.55 | 0.03 | 0.0010 | N | 0.25 | | |
| VI-8 | 0.63 | 0.85 | 8.31 | 0.016 | 0.041 | 0.081 | 1.96 | 0.25 | 22.42 | 0.02 | 0.0006 | N | 0.25 | Ca | 0.010 |
| VI-D | 0.63 | 0.83 | 7.65 | 0.016 | 0.044 | 0.074 | 1.68 | 0.23 | 22.31 | 0.05 | 0.0038 | N | 0.22 | | |
| VI-9 | 0.25 | 0.90 | 1.25 | 0.020 | 0.243 | 0.472 | 1.94 | 12.42 | 22.45 | 0.04 | 0.0031 | | | | |
| VI-E | 0.21 | 0.91 | 1.26 | 0.018 | 0.250 | — | — | 12.49 | 21.96 | 0.02 | 0.0072 | | | | |
| VI-10 | 0.50 | 0.25 | 9.30 | 0.022 | 0.367 | 0.387 | 1.05 | 0.25 | 21.15 | 0.02 | 0.0021 | N | 0.28 | | |
| VI-F | 0.53 | 0.28 | 9.20 | 0.018 | 0.355 | — | — | 0.23 | 21.16 | 0.02 | 0.0045 | N | 0.25 | | |
| VI-11 | 0.06 | 0.42 | 17.30 | 0.016 | 0.033 | 0.103 | 3.12 | 2.11 | 17.44 | 0.01 | 0.0053 | N | 0.35 | | |
| VI-G | 0.07 | 0.40 | 17.25 | 0.018 | 0.035 | 0.105 | 3.00 | 2.10 | 17.35 | 0.01 | 0.0055 | N | 0.31 | | |
| VI-H | 0.06 | 0.42 | 17.11 | 0.013 | 0.025 | — | — | 2.01 | 17.21 | 0.02 | 0.0173 | N | 0.30 | | |
| VI-12 | 0.41 | 2.21 | 0.46 | 0.011 | 0.074 | 0.175 | 2.36 | 0.21 | 11.55 | 1.11 | 0.0021 | | | | |
| VI-I | 0.45 | 2.23 | 0.44 | 0.015 | 0.077 | — | — | 0.23 | 13.41 | 1.09 | 0.0044 | | | | |
| VI-13 | 0.80 | 2.00 | 0.44 | 0.015 | 0.054 | 0.016 | 0.30 | 1.48 | 19.87 | 0.03 | 0.0010 | | | | |
| VI-J | 0.75 | 2.11 | 0.33 | 0.014 | 0.055 | — | — | 1.46 | 19.23 | 0.02 | 0.0025 | | | | |
| VI-14 | 0.17 | 0.32 | 0.76 | 0.038 | 0.015 | 0.001 | 0.07 | 0.23 | 11.51 | 0.60 | 0.0028 | V | 1.20 | N | 0.10 |
| | | | | | | | | | | | | Nb | 1.00 | Ta | 0.25 |
| VI-K | 0.18 | 0.35 | 0.77 | 0.036 | 0.015 | — | — | 0.22 | 11.46 | 0.65 | 0.0057 | V | 1.15 | N | 0.15 |
| | | | | | | | | | | | | Nb | 1.05 | Ta | 0.18 |

TABLE VI-1-continued

| Run No. | C % | Si % | Mn % | P % | S % | Te % | Te/S | Ni % | Cr % | Mo % | O % | Others % | | Pb, Se, Ca, Bi % | | | |
|---|---|---|---|---|---|---|---|---|---|---|---|---|---|---|---|---|---|
| VI-15 | 0.10 | 0.67 | 1.55 | 0.020 | 0.010 | 0.004 | 0.40 | 19.55 | 22.11 | 3.10 | 0.0088 | W | 2.50 | Co | 21.05 | N | 0.15 |
| | | | | | | | | | | | | Ca | 0.032 | Nb | 0.85 | | |
| | | | | | | | | | | | | Se | 0.07 | Ta | 0.35 | | |
| VI-L | 0.10 | 0.68 | 1.25 | 0.018 | 0.019 | — | — | 19.63 | 22.53 | 3.15 | 0.0163 | W | 2.45 | Co | 22.10 | | |
| | | | | | | | | | | | | N | 0.18 | Nb | 0.75 | Ta | 0.60 |

TABLE VI-2

| Run No. | Sulfides L/S | Sulfides R (%) | Formability Heat Treatment | Formability Critical Strain | Machinability Heat Treatment | Machinability 60 min-Life Speed (m/min) | High Temperature Strength (800° C.) Heat Treatment | Tensile Strength (kg/mm²) | Reduction of Area (%) |
|---|---|---|---|---|---|---|---|---|---|
| VI-1 | 2.4 | 82 | | 1.71 | | 155 | | 21.5 | 96.5 |
| VI-2 | 2.5 | 86 | 950° C. × 1 hr Oil | 1.65 | 950° C. × 1 hr Oil | 163 | 950° C. × 15 min Oil | 22.3 | 95.4 |
| VI-A | 11.5 | 0 | Cooling | 1.35 | Cooling | 135 | Cooling | 21.3 | 95.5 |
| VI-3 | 2.4 | 86 | | 1.70 | | 199 | 1000° C. × 15 min Air Cooling | 31.5 | 74.1 |
| VI-4 | 2.3 | 89 | 1000° C. × 1 hr Air | 1.61 | 1000° C. × 1 hr Air | 205 | | 33.2 | 74.1 |
| VI-B | 12.3 | 0 | Cooling | 1.31 | Cooling | 165 | 780° C. × 15 min Air Cooling | 32.5 | 73.2 |
| VI-5 | 4.3 | 83 | | 1.66 | | 163 | 1000° C. × 15 min Air Cooling | 45.8 | 34.3 |
| VI-6 | 2.7 | 82 | 1000° C. × 1 hr Air | 1.61 | 1000° C. × 1 hr Air | 171 | | 46.3 | 33.1 |
| VI-C | 13.8 | 2 | Cooling | 1.33 | Cooling | 125 | 780° C. × 15 min Air Cooling | 44.5 | 30.0 |
| VI-7 | 3.2 | 85 | | 1.85 | | 72 | 1200° C. × 15 min Water Quenching | 38.3 | 6.7 |
| VI-8 | 2.6 | 84 | 1200° C. × 1 hr Air | 1.80 | 1200° C. × 1 hr Air | 79 | | 38.7 | 7.1 |
| VI-D | 10.5 | 0 | Cooling | 1.48 | Cooling | 52 | 780° C. × 15 min Air Cooling | 38.0 | 6.5 |
| VI-9 | 2.4 | 86 | | 2.15 | | 179 | 1100° C. × 15 min Water Quenching | 14.3 | 52.3 |
| VI-E | 15.3 | 0 | 1100° C. × 1 hr Water Quenching | 1.71 | 1100° C. × 1 hr Water Quenching | 138 | 700° C. × 2 hr Air Cooling | 14.1 | 52.1 |
| VI-10 | 2.5 | 85 | 1200° C. × 1 hr | 2.03 | 1200° C. × 1 hr | 177 | 1200° C. × 15 min Water Quenching | 35.4 | 7.0 |
| VI-F | 13.7 | 0 | Water Quenching | 1.65 | Water Quenching | 135 | 760° C. × 15 min Air Cooling | 35.1 | 6.5 |
| VI-11 | 1.8 | 88 | | 2.11 | | 201 | 1100° C. × 15 min Water Quenching | 24.6 | 29.1 |
| VI-G | 10.2 | 25 | 1100° C. × 1 hr Water | 1.72 | 1100° C. × 1 hr Water | 156 | 700° C. × 15 min Air Cooling | 24.1 | 25.1 |
| VI-H | 13.1 | 0 | Quenching | 1.68 | Quenching | 155 | | 24.3 | 28.4 |
| VI-12 | 1.8 | 87 | | 1.91 | | 170 | 1050° C. × 15 min | 31.5 | 72.1 |
| VI-I | 11.5 | 0 | 1050° C. × 15 min | 1.54 | 1050° C. × 15 min | 130 | Oil Cooling | 30.5 | 71.3 |
| VI-13 | 2.3 | 83 | Oil Cooling | 1.88 | Oil Cooling | 96 | 750° C. × 15 min Water Quenching | 9.1 | 93.1 |
| VI-J | 12.7 | 0 | | 1.51 | | 73 | | 9.0 | 91.5 |
| VI-14 | 2.7 | 81 | 1150° C. × 1 hr | 1.53 | 1150° C. × 1 hr | 83 | 1150° C. × 15 min Air Cooling | 12.0 | 93.5 |
| VI-K | 13.5 | 0 | Air Cooling | 1.23 | Air Cooling | 62 | 700° C. × 15 min Air Cooling | 11.2 | 93.6 |
| VI-15 | 2.9 | 83 | 1170° C. × 1 hr | 1.69 | 1170° C. × 1 hr | 58 | 1170° C. × 15 min Water Quenching | 21.9 | 27.5 |
| VI-L | 12.1 | 0 | Air Cooling | 1.35 | Air Cooling | 42 | 800° C. × 15 min Air Cooling | 21.5 | 27.3 |

EXAMPLE 7

(Bearing steel)

Steel ingots of the chemical composition shown in Table VII-1 were prepared through the procedure similar to that of Example I, and tested.

Table VII-2 shows the record on the inclusions in the steel.

Table VII-3 shows the test results of mechanical anisotropy. The specimens were tested after spheroidizing-annealing by being heated at 800° C. and gradually cooled in a furnace.

Table VII-4 shows the test results of machinability. The specimens were also spheroidizing-annealed under the above condition.

TABLE VII-1

| Run No. | Chemical Composition (%) C | Si | Mn | Cr |
|---|---|---|---|---|
| VII-1 | 1.04 | 0.22 | 0.32 | 1.42 |
| VII-A | 1.08 | 0.25 | 0.28 | 1.40 |

TABLE VII-2

| Run No. | Areal Percentage Inclusion A | Inclusion B | A/B % | C % | L/S |
|---|---|---|---|---|---|
| VII-1 | MnS—MnTe 0.004 | MnS 0.042 | 9.5 | 99 | 3.0 |
| VII-A | — | MnS 0.050 | — | — | 18.6 |

TABLE VII-3

| Run No. | Tensile Strength (kg/mm²) Rolling Direction X | Rec-tangular Direction Y | Y/X | Reduction of Area (%) Rolling Direction X | Rec-tangular Direction Y | Y/X |
|---|---|---|---|---|---|---|
| VII-1 | 67 | 66 | 0.99 | 68 | 42 | 0.62 |
| VII-A | 64 | 60 | 0.94 | 66 | 25 | 0.38 |

TABLE VII-4

| Run No. | Drill Life (mm) |
|---|---|
| VII-1 | 120 |
| VII-A | 80 |

EXAMPLE 8

(Tool steel)

Steel ingots of the composition given in Table VIII-1 were produced through the procedure similar to that of Example I, in which the hot rolling at 1200° to 1300° C. was substituted with hot forging at 1150° to 1250° C. (the forging ratio was also about 12).

Table VIII-2 shows the record on the inclusions.

Table VIII-3 shows the test results of mechanical anisotropy. Prior to the test, the specimens were quenched from 1000° C. by air cooling, and then, tempered at 550° followed by air cooling.

Table VIII-4 shows the test results of machinability. The specimens were, prior to the test, heated at 850° C. and cooled in a furnace for spheroidizing-annealing.

TABLE VIII-1

| Run No. | Chemical Composition (%) C | Si | Mn | V | Cr | Mo |
|---|---|---|---|---|---|---|
| VIII-1 | 0.38 | 1.05 | 0.39 | 1.05 | 5.21 | 1.28 |
| VIII-A | 0.36 | 0.99 | 0.42 | 1.13 | 5.04 | 1.30 |

TABLE VIII-2

| Run No. | Areal Percentage Inclusion A | Inclusion B | A/B % | C % | L/S |
|---|---|---|---|---|---|
| VIII-1 | MnS—MnTe 0.005 | MnS 0.040 | 13 | 96 | 2.6 |
| VIII-A | MnS—MnTe 0.0003 | MnS 0.044 | 0.7 | — | 9.5 |

TABLE VIII-3

| Run No. | Tensile Strength (kg/mm²) Rolling Direction X | Rec-tangular Direction Y | Y/X | Reduction of Area (%) Rolling Direction X | Rec-tangular Direction Y | Y/X |
|---|---|---|---|---|---|---|
| VIII-1 | 130 | 128 | 0.98 | 50 | 39 | 0.78 |
| VIII-A | 128 | 120 | 0.94 | 46 | 20 | 0.43 |

TABLE VIII-4

| Run No. | Drill Life (mm) |
|---|---|
| VIII-1 | 80 |
| VIII-A | 40 |

EXAMPLE 9

(Spring steel)

Steel ingots of the composition given in Table IX-1 were procedure similar to that of Example I and tested.

Table IX-2 shows the record on the inclusions.

Table IX-3 shows the test results of mechanical anisotropy. The specimens were quenched from 850° C. by oil cooling and tempered at 500° C. followed by air cooling.

Table IX-4 shows the test result of machinability. The specimens were subjected to spheroidizing-annealing by being heated at 800° C. and cooled in a furnace.

TABLE IX-1

| Run No. | Chemical Composition (%) C | Si | Mn |
|---|---|---|---|
| IX-1 | 0.60 | 1.68 | 0.88 |
| IX-A | 0.60 | 1.70 | 0.86 |

TABLE IX-2

| Run No. | Areal Percentage Inclusion A | Inclusion B | A/B % | C % | L/S |
|---|---|---|---|---|---|
| IX-1 | MnS—MnTe 0.004 | MnS 0.055 | 7.3 | 99 | 2.8 |
| IX-A | — | MnS 0.061 | — | — | 24.2 |

TABLE IX-3

| Run No. | Tensile Strength (kg/mm²) Rolling Direction X | Rec-tangular Direction Y | Y/X | Reduction of Area (%) Rolling Direction X | Rec-tangular Direction Y | Y/X |
|---|---|---|---|---|---|---|
| IX-1 | 136 | 135 | 0.99 | 38 | 28 | 0.74 |
| IX-A | 134 | 125 | 0.93 | 35 | 18 | 0.51 |

TABLE IX-4

| Run No. | Drill Life (mm) |
|---|---|
| IX-1 | 240 |
| IX-A | 160 |

EXAMPLE 10

Specimens of Run No. I-1 of Example I were, after hot rolling, soaked at 900° C., 1000° C. or 1100° C. for 1 hour, and quenched in water. They were then observed with a microscope to learn the form of inclusions therein. Cross sections of the specimens are shown, in comparison with the specimen as rolled, in FIGS. 2A through 2E. (Magnification: X600)

In the inclusion particles, dark parts in the middle is the inclusion B, or MnS, and lighter parts on both sides are the inclusion A, or MnS-Mnte. From these photographs it is seen that the inclusion A is elongated through the hot rolling while the inclusion B maintains its spherical form, that the inclusion A, when soaked at a high temperature, exhibits the tendency to recover its original spherical form, and that the spheroidization proceeds to higher extent as the temperature is higher for the same soaking period.

Figure 1:
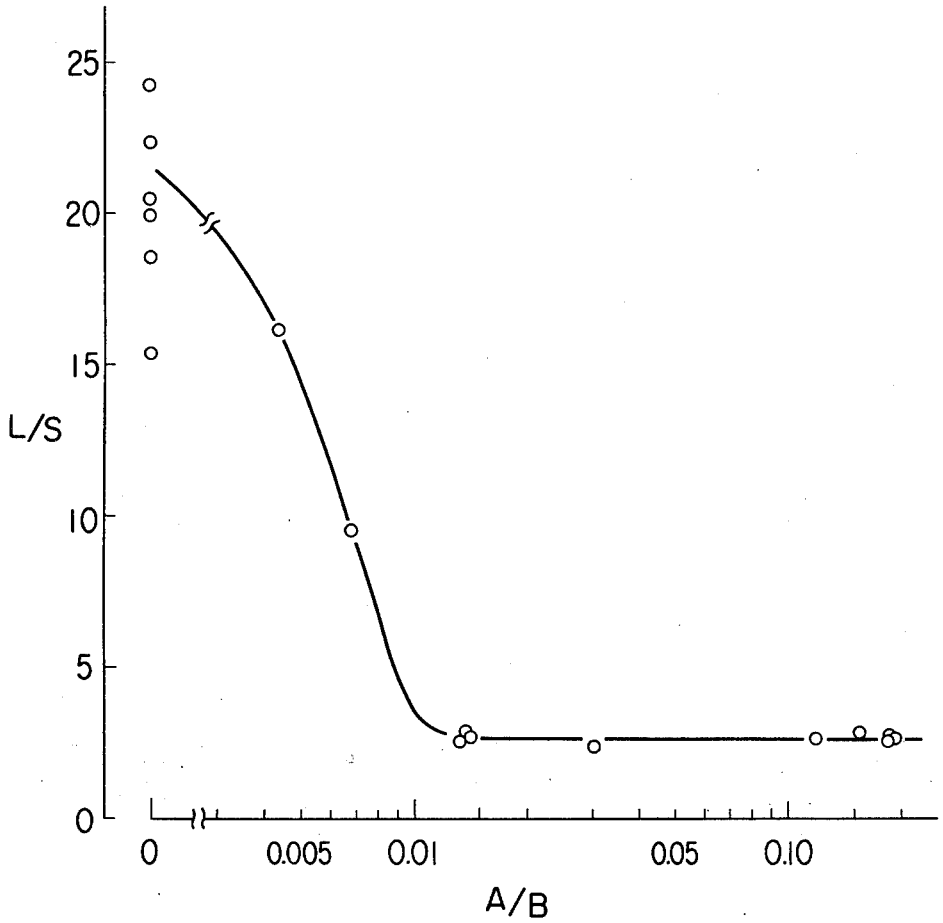
FIG. 1 is a graph plotting the relation between the ratio of areal percentage of inclusion A to areal percentage of inclusion B (abscissa) and average of the aspect ratio of length to width of inclusion particles (ordinate).

In the samples mentioned above, relationship between A/B or the rate of areal percentage of the inclusion A to that of inclusion B and average L/S or the ratio of length to width of the inclusion particles was plotted to give FIG. 1. The graph of FIG. 1 teaches that, if the areal percentage rate A/B is 1% or more, the inclusion particles are nearly spherical.

EXAMPLE 11

(Carbon steel for structural use)

In an arc-furnace steels of the composition of Table XI-1 were prepared and poured into a ladle. At the time of casting thus prepared steel to 1.3 ton ingots, the substance having the composition of the inclusion B was added to stream of the molten steel.

The cast ingots were subjected to the hot working and heat-treatment same as those of Example I, and the form of the inclusion was observed. The results are shown in Table XI-2.

TABLE XI-1

| | Chemical Composition (%) | | | | |
|---|---|---|---|---|---|
| Run No. | C | Si | Mn | S | Te |
| XI-1 | 0.46 | 0.25 | 0.55 | 0.015 | 0.006 |
| XI-2 | 0.45 | 0.29 | 0.50 | 0.030 | 0.003 |
| XI-3 | 0.45 | 0.26 | 0.48 | 0.051 | 0.008 |

TABLE XI-2

| Run No. | Added Inclusion B volume % | Areal Percentage Inclusion A | Areal Percentage Inclusion B | Added Portion of Inclusion B % | A/B % | C % | L/S |
|---|---|---|---|---|---|---|---|
| XI-1 | 0.19 | 0.052 | 0.26 | 73 | 20 | 100 | 2.7 |
| XI-2 | 0.10 | 0.017 | 0.24 | 42 | 7 | 98 | 2.6 |
| XI-3 | 0.01 | 0.088 | 0.25 | 4 | 35 | 91 | 2.9 |

We claim:

1. A free cutting steel containing controlled inclusions characterized in that the steel contains inclusion A which softens or melts at a temperature below 1000° C. and inclusion B which has a melting point above 1300° C. but exhibits plasticity at a temperature between 900° and 1300° C., the inclusion A and the inclusion B existing in a mutually adhered form, and areal percentage of inclusion A being at least 1% of areal percentage of inclusion B.

2. A free cutting steel of claim 1, wherein the adhesion of the inclusions is in such a form that the inclusion A surrounds the inclusion B.

3. A free cutting steel of claim 1, wherein the areal percentage of the inclusion A is in the range of 1 to 150% of the areal percentage of inclusion B.

4. A free cutting steel of claim 1, wherein the inclusion A is a member of the group consisting of:

Pb, Bi, MnS-TeS, $SiO_2$—$K_2O$, $SiO_2$—$Na_2O$, $SiO_2$—$K_2O$—$Al_2O_3$, $SiO_2$—$Na_2O$—$Al_2O_3$ and $SiO_2$—$Na_2O$—CaO—MnO;

and the inclusion B is a member of the group consisting of:

MnS, MnSe and Mn(S, Se).

5. A free cutting steel of claim 1, wherein the steel is a carbon steel or a alloyed steel for structural use.

6. A free cutting steel of claim 1, wherein the steel is a stainless steel.

7. A free cutting steel of claim 1, wherein the steel is a heat-resistant steel.

8. A free cutting steel of claim 1, wherein the steel is a bearing steel.

9. A free cutting steel of claim 1, wherein the steel is a tool steel or a spring steel.

10. A free cutting stainless steel containing controlled inclusions characterized in that the steel contains inclusion A which softens or melts at a temperature below 1,000° C. and inclusion B which has a melting point above 1,300° C. but exhibits plasticity at a temperature between 900° and 1,300° C., the inclusion A and the inclusion B existing in a mutually adhered form, and area percentage of inclusion A being at least 1% of area percentage of inclusion B, said stainless steel having good formability in cold forging characterized in that the steel contains C up to 2.0%, Si up to 2.0%, Mn up to 10%, Cr 10 to 30%, S up to 0.4% and Te up to 0.5%, wherein %Te/%S being at least 0.4, and 0 being up to 0.015% and the balance being substantially Fe, and at least 80% of the sulfide-based inclusion particles in the steel of a length of 2μ or longer have an aspect ratio not higher than 10.

11. A free cutting heat-resistant stainless steel containing controlled inclusions characterized in that the steel contains inclusion A which softens or melts at a temperature below 1,000° C. and inclusion B which has a melting point above 1,300° C. but exhibits plasticity at a temperature between 900° and 1,300° C., the inclusion A and the inclusion B existing in a mutually adhered form, an area percentage of inclusion A being at least 1% of area percentage of inclusion B, said stainless steel having good formability in cold forging characterized in that the steel contains C up to 1.0%, Si up to 5.0%, Mn up to 20%, Cr 7.5 to 30%, S up to 0.4% and Te up to 0.05%, wherein %Te/%S being at least 0.04, and 0 up to 0.015% and the balance being substantially Fe, and that at least 80% of the sulfide-based inclusion particles in the steel of a length of 2μ or longer have an aspect ratio not higher than 10.

12. A free cutting steel of claim 10 or 21 having good formability in cold forging, wherein the steel further contains at least one alloying element of the following groups:

Ni up to 40%,
Mo up to 4.0%,
one or more of W up to 5.0%
Ti up to 2.0%, V up to 2.0%,
Nb up to 1.5% and
rare earth metals up to 0.5%,
Al up to 2.0%,
Co up to 25%,
one or more of B up to 0.05%,
N up to 0.8% and Zr up to 2%
Ta up to 1.5%, and
Cu up to 7%.

13. A free cutting steel of claim 10 or 11 having good formability in cold forging, wherein the steel further contains at least one of Pb up to 0.3%, Se up to 0.3%, Ca up to 0.06% and Bi up to 0.3%.

* * * * *